US007244478B2

(12) United States Patent
Kondo et al.

(10) Patent No.: US 7,244,478 B2
(45) Date of Patent: Jul. 17, 2007

(54) RECORDING MEDIUM HAVING INK-RECEIVING LAYER AND METHOD OF MANUFACTURING THE SAME

(75) Inventors: Yuji Kondo, Tokyo (JP); Shigehira Iida, Chiba (JP); Tsuyoshi Santo, Kanagawa (JP); Motoaki Sato, Tokyo (JP); Kenichi Yamaguchi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 124 days.

(21) Appl. No.: 10/664,872

(22) Filed: Sep. 22, 2003

(65) Prior Publication Data

US 2004/0058098 A1 Mar. 25, 2004

Related U.S. Application Data

(63) Continuation of application No. PCT/JP03/07001, filed on Jun. 3, 2003.

(30) Foreign Application Priority Data

Jun. 4, 2002 (JP) ..... 2002-162911

(51) Int. Cl.
*B41M 5/40* (2006.01)

(52) U.S. Cl. ..... 428/32.24; 428/32.25; 428/32.26; 428/32.28; 428/32.34

(58) Field of Classification Search ..... 428/32.24, 428/32.25, 32.26, 32.28, 32.34
See application file for complete search history.

(56) References Cited

U.S. PATENT DOCUMENTS 4,202,870 A 5/1980 Weber et al. ..... 423/630

(Continued)

FOREIGN PATENT DOCUMENTS

EP 1 002 657 A1 5/2000

(Continued)

OTHER PUBLICATIONS

Barrett et al., "The Determination of Pore Volume and Area Distribution in Porous Substances. I. Computations from Nitrogen Isotherms", The Journal of the American Chemical Society, vol. 73, Jan.-Mar. 1951, pp. 373-380.

(Continued)

*Primary Examiner*—B. Shewareged
(74) *Attorney, Agent, or Firm*—Fitzpatrick, Cella, Harper & Scinto

(57) ABSTRACT

A method of manufacturing a recording medium with an excellent productivity is provided. The method provides a recording medium having excellent ink absorbency and coloring property and includes an ink-receiving layer in which a binder is restricted and controlled. The present invention provides a method of manufacturing a recording medium including the steps of: performing a surface treatment on a substrate; and forming an ink-receiving layer using at least a pigment, polyvinyl alcohol, and a coating liquid that contains at least one selected from the group consisting of boric acid and borate. In this method, the surface-treatment step includes a first surface treatment and a second surface treatment. In the first surface treatment, a coating liquid that contains at least one selected from the group consisting of boric acid and borate is applied followed by being dried and solidified. In the second surface treatment, after the first surface treatment, a coating liquid that contains at least one selected from the group consisting of boric acid and borate is applied on the substrate. While the substrate is in a state of being wet by the coating liquid applied in the second surface treatment, the substrate is further coated with a coating liquid for forming the ink-receiving layer.

6 Claims, 1 Drawing Sheet

U.S. PATENT DOCUMENTS

| | | | | |
|---|---|---|---|---|
| 4,242,271 | A | 12/1980 | Weber et al. | 260/448 |
| 4,248,852 | A | 2/1981 | Wakabayashi et al. | 423/626 |
| 4,313,124 | A | 1/1982 | Hara | 346/140 R |
| 4,345,262 | A | 8/1982 | Shirato et al. | 346/140 R |
| 4,463,359 | A | 7/1984 | Ayata et al. | 346/1.1 |
| 4,723,129 | A | 2/1988 | Endo et al. | 346/1.1 |
| 4,740,796 | A | 4/1988 | Endo et al. | 346/1.1 |
| 4,877,686 | A | 10/1989 | Riou et al. | 428/32.18 |
| 5,523,149 | A | 6/1996 | Kijimuta et al. | 428/307.3 |
| 5,635,291 | A | 6/1997 | Yoshino et al. | 428/304.4 |
| 5,738,932 | A | 4/1998 | Kondo et al. | 428/195 |
| 5,800,916 | A | 9/1998 | Yoshino et al. | 428/328 |
| 5,804,320 | A | 9/1998 | Tomioka et al. | 428/478.2 |
| 5,846,647 | A | 12/1998 | Yoshino et al. | 428/328 |
| 5,851,654 | A | 12/1998 | Yoshino et al. | 428/328 |
| 5,869,177 | A | 2/1999 | Yoshino et al. | 428/328 |
| 5,955,185 | A | 9/1999 | Yoshino et al. | 428/304.4 |
| 5,962,124 | A | 10/1999 | Yoshino et al. | 428/328 |
| 5,965,252 | A | 10/1999 | Santo et al. | 428/329 |
| 6,214,449 | B1 * | 4/2001 | Otani et al. | 428/32.24 |
| 6,342,289 | B1 | 1/2002 | Eguchi et al. | 428/195 |
| 6,495,242 | B1 * | 12/2002 | Tsuchiya et al. | 428/32.24 |
| 6,558,740 | B1 | 5/2003 | Santo et al. | 427/146 |
| 6,677,006 | B2 * | 1/2004 | Otani et al. | 428/32.25 |
| 2002/0064633 | A1 | 5/2002 | Wakata et al. | 428/32.39 |
| 2003/0152721 | A1 | 8/2003 | Barcock et al. | 428/32.35 |
| 2003/0219551 | A1 * | 11/2003 | Burch et al. | 428/32.1 |

FOREIGN PATENT DOCUMENTS

| | | | |
|---|---|---|---|
| EP | 1 080 938 | A2 | 3/2001 |
| EP | 1 111 452 | A2 | 6/2001 |
| EP | 1 321 300 | A1 | 6/2003 |
| JP | 57-44605 | B2 | 9/1982 |
| JP | 7-76161 | A | 3/1995 |
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 9-314987 | A | 12/1997 |
| JP | 11-291621 | A | 10/1999 |
| JP | 2001-138628 | A | 5/2001 |
| JP | 2001-334748 | A | 12/2001 |
| JP | 1 226 959 | A2 | 7/2002 |
| JP | 2002-225423 | A | 8/2002 |
| JP | 2002-307823 | A | 10/2002 |
| JP | 2002-321445 | A | 11/2002 |
| JP | 2003-94800 | A | 4/2003 |
| JP | 2003-165269 | A | 6/2003 |
| JP | 2003-191633 | A | 7/2003 |
| JP | 2003-226074 | A | 8/2003 |
| WO | WO 02/34541 | A1 | 5/2002 |

OTHER PUBLICATIONS

Brunauer et al., "Adsorption of Gases in Multimolecular Layers", The Journal of the American Chemical Society, vol. 60, Jan.-Jun. 1938, pp. 309-319.

* cited by examiner

RECORDING MEDIUM HAVING INK-RECEIVING LAYER AND METHOD OF MANUFACTURING THE SAME

This application is a continuation of International Application No. PCT/JP03/07001, filed on Jun. 3, 2003, which claims the benefit of Japanese Patent Application No. 2002-162911 filed Jun. 4, 2002.

BACKGROUND OF THE INVENTION

1. Field of the Invention

The present invention relates to a method of manufacturing a recording medium that improves yields in mass production and shows stable characteristics, and also relates to a recording medium having a novel configuration manufactured by such a method. In particular, the invention relates to a method of manufacturing a recording medium suitable for inkjet-recording. More specifically, the invention relates to: a method of manufacturing a recording medium with improved productivity, which allows a manufacturer to stably produce a recording medium having excellent characteristics in quantity and eventually provides a recording medium with excellent characteristics with respect to ink-absorbency and color development while preventing generation of cracks in an ink-receiving layer of the recording medium; and a recording medium manufactured by such a method.

2. Related Background Art

In late years, for an inkjet-recording system, the size reduction of an ink droplet and the improvement of ink have been extensively advanced since improved recording characteristics of such a system, such as a higher recording speed and a higher definition, have been attained, resulting in further improved image qualities. Therefore, the inkjet-recording system, as being represented by a high-resolution inkjet printer described as a photo printer, is capable of providing a high-quality image, which can be compared favorably with a silver halide photograph. Thus, the number of users who print full-color images taken by digital cameras or the like is increasing now. Furthermore, with respect to a recoding medium on which such image information is to be recorded, a photo-grade glossy recording medium becomes demanded for obtaining an image like a silver halide photograph. For addressing such a demand, it has been conventionally known that a high-glossy recording medium can be obtained by applying a casting method on a recording medium having an ink-receiving layer in which alumina hydrate and polyvinyl alcohol are used as components of a binder. In Particular, in JP 2001-138628 A (Document 1) that attains a gloss for inkjet, there is disclosed an invention in which an ink-receiving layer is re-swelled as a technique for improving the casting method.

Such a formation of the ink-receiving layer using both alumina hydrate and polyvinyl alcohol as components of a binder has been well known in the art. In this case, however, it is important to manage a change with time in thickening of a coating liquid that contains alumina hydrate and polyvinyl alcohol. For recognizing a part of such a change with time, in JP 7-76161 A (Document 2), there are proposed an alumina-sol coating liquid and a resin film on which such a coating liquid is applied. In Document 2, the coating liquid contains alumina hydrate, polyvinyl alcohol, and a predetermined amount of boric acid or borate. In this document, however, it is only focused on the coating liquid directly applied on the resin film, and in addition there is only disclosed one having 23 g/m$^2$ of an ink-receiving layer.

Furthermore, with reference to Document 2, JP 11-291621 A (Document 3) indicates the difficulty in stable coating using such a coating liquid disclosed in Document 2 (both Document 2 and Document 3 have been filed by the same applicant). Document 3 is based on a technical idea that denies improvement of the coating liquid and discloses a pre-coating substrate paper obtained by drying base paper mainly composed of paper after a sizing treatment. In this document, more specifically, disclosed is the invention in which base paper is produced in advance by a dry treatment with 0.5 to 1.5 g/m$^2$ of boric acids and a paper-surface treating agent such as a surface paper strengthning agent or a surface sizing agent using a size press. In the example in Document 3, after preparing the base paper, a coating liquid without containing a crosslinking agent composed of boehmite and polyvinyl alcohol is prepared and is then applied on the base paper. Furthermore, the well-known size press means in general that a sizing agent is slightly applied or immersed in the surface of the base paper and is then dried with a drum drier or the like for improving the waterproof property, surface flatness, print appropriateness, and so on of the base paper.

Whatever the case may be, in each of Documents 2 and 3, the conventional problem of thickening of the coating liquid is recognized. In Document 2, the composition of the coating liquid has been studied to find out means to solve such a problem. In Document 3, on the other hand, the base paper is only provided to find out means to solve such a problem.

SUMMARY OF THE INVENTION

The inventors of the present invention have carried out investigations on the mechanisms of forming an ink-receiving layer from various viewpoints for conventional technical standards to conduct essential technical analyses on pigments contained in a coating liquid, binders of the pigments, and solvents for dissolving the binders. As a result, the inventors of the present invention obtained a first finding. That is, it is important to cause "a mechanism in which a binder taking a behavior as a dispersant of pigments in a coating liquid is located around the pigments which start to be aggregated at the time of drying the coating liquid to bind the pigments together", while keeping a mixture state in the coating liquid as much as possible. Furthermore, the inventors of the present invention obtained a second finding. That is, it is important to distribute the binder uniformly in the ink receiving layer because, in a recording medium itself, variations in conditions of the existence of the binder may lead to an excess absorption of ink, causing a low-density portion, or conversely lead to a less absorption of ink, causing a decrease in image quality due to ink overflow.

Therefore, as a technical point of view to achieve those findings, at least one of the following objects can be given. That is, a first main object to be addressed is "to properly crosslink the binder around the interface between a coating surface and the coating liquid, while preventing the binder and its solvent from being moved in large quantities from the coating liquid to the coating surface (the coating member) to be coated with the coating liquid". As a subsequent stage, a second object is "to utilize the pigment characteristics not for forming a cross-linked state of only the binder but for flocculating and thickening of a pigment to form a reasonable pore distribution". A third object is "to provide a preferable embodiment for forming the above coating surface". Further more, a fourth object which is "to increase the recording characteristics obtained by a recording medium produced by the manufacturing method that attains each of the above objects and constructional characteristics of the recording medium". More specifically, another technical problem to be solved by the present invention is to allow the polyvinyl alcohol soluble in water (preferably, pure water for a countermeasure against contaminant to alumina) to mainly function as a solute to water in a coating liquid to be used for the formation of an ink-receiving layer and to allow the solute to be functionally changed suddenly to a binder in the resulting coating layer without penetration and dispersion with water.

On the other hand, for producing a recording medium having sufficient ink absorbency where a large amount of ink necessary for photo-printer recording can be promptly absorbed, the dry-coating amount of the ink-receiving layer is generally increased. However, the inventors of the present invention found that there is a disadvantage in that many surface cracks can be generated on the recording medium when the ink-receiving layer is simply prepared so as to have a weight of 30 $g/m^2$ or more (corresponding to the thickness thereof after drying) for absorbing a large amount of ink. In this way, in a point of view to make the recording medium so as to make the ink-receiving layer have a weight of 30 $g/m^2$ or more (corresponding to the thickness thereof after drying), the present invention copes with each of the above problems to provide a fabrication technology which is ready for an increase in thickness of the ink-recording layer and to provide a recording medium suitable for photo-printer recording, which can be recognized as a fifth object.

Furthermore, if it is assumed that the coating liquid contains a gelling agent (a crosslinking agent), the viscosity of the coating liquid increases and a gelled product is generated when the content of the gelling agent is enough to cause a complete crosslinking, resulting in difficulty of coating. Thus, the content of the gelling agent has its own upper limit. In this case, simultaneously, as the content of the coating liquid is not sufficient so that the degree of crosslinking becomes small. As a result, there is a sixth object to solve such a problem that it is difficult to obtain an ink-receiving layer having the desired characteristics.

The present invention has been made on the basis of the above recognition to solve at least one of the above first main object and so on. Accordingly, a primary object of the present invention is to provide: an innovative technology for manufacturing an ink-receiving layer having pigments (such as alumina hydrate) by developing the mechanisms of forming binders in and around the ink-receiving layer; and a recording medium which can be obtained by such a manufacturing method or obtained as a discrete final product having excellent features. In particular, the present invention provides a method of manufacturing a recording medium having excellent ink absorbency and color development with improved productivity, in which a binder not only provided as a binder itself but also provided as a dispersant can be substantially controlled.

The present invention pays its attention to a correlation with a layer region that includes an ink-recording surface side of the ink-receiving layer and its inner structure, and a coating surface on which the ink-receiving layer is formed. As a representative example, the binder in the coating liquid is prevented from being lost to the coating surface side by use of a reaction rate or reaction state on a liquid-to-liquid contact interface to attain an effective removal of a solvent in the coating liquid or the like, thereby achieving at least one of the above objects. In the present invention, the term "layer region" is used because there is a certain thickness. However, there is no need to form a complete layer. The region may be a thick region.

According to a first aspect of the present invention, there is provided a recording medium having on an ink-recording surface side an ink-receiving layer that contains at least a pigment for retaining a coloring material of ink and a binder for the pigment, in which the ink-receiving layer includes a first layer region where the binder is cross-linked by a first crosslinking agent to become uniform relative to the pigment; and a second layer region where the binder is cross-linked by a second crosslinking agent such that the degree of crosslinking of the second layer region is larger than that of the first layer region, and in which the first layer region is located closer to the ink-recording surface side than the second layer region. Therefore, according to the first aspect of the present invention, there is provided a novel recording medium that achieves the fourth object obtained by achieving the first object. Since the loss of the binder described above can be prevented and pores caused by the aggregated pigment are also formed stably in the second layer region by the binder having a large degree of crosslinking, ink recorded in the ink-receiving layer can be appropriately absorbed, and a clear image formation can be attained without causing the distribution of ink around the ink-absorbed portion in the ink-receiving layer.

Here, the above degree of crosslinking can be judged to be a relative numerical quantity difference or numerical ratio (e.g., 2 folds or more) between the common element (e.g., boron "B") contained in the first and second crosslinking agents and the common element of the first and second layer regions. As a specific material and a specific manufacturing method therefor, provided is a method of applying a coating liquid on a wet surface to form the above recording medium, in which the coating liquid is prepared by dissolving and mixing alumina hydrate as the above pigment, polyvinyl alcohol as the above binder, and ortho-boric acid as the above first crosslinking agent, and the wet surface contains sodium tetraborate as the second crosslinking agent for the formation of the second layer region. Furthermore, in the coating liquid, there is provided a practical example in which the content of the ortho-boric acid per unit area is smaller than the content of the sodium tetraborate in the wet surface.

According to a second aspect of the present invention, there is provided a recording medium having on an ink-recording surface side an ink-receiving layer that contains at least a pigment which retains a coloring material of ink and shows variations in viscosity depending on pH and a binder for the pigment, in which the ink-receiving layer includes a first layer region in which the binder is cross-linked by a first crosslinking agent having a pH value for retaining the pigment at a low viscosity; and a second layer region in which the binder is cross-linked by a second crosslinking agent having a pH value for retaining the pigment at a high viscosity, and in which the first layer region is located closer to the ink-recording surface side than the second layer region. Therefore, the second aspect of the present invention is to achieve the above second and fourth objects. In other words, the relation between the pigment and the first and second crosslinking agents that constitute the ink-receiving layer causes variations in pH to make the pigment highly viscous and concurrently the crosslinking agent cross-links the binder, resulting in a rational formation of the second layer region. As a result, the formation of an excellent pore distribution and the binder cross-linked without loss allow an appropriate absorption of ink recorded in the ink-receiving layer, while preventing the ink and the coloring material thereof from being dispersed around the ink-absorbed portion in the ink-receiving layer. Consequently, the formation of a clearer image can be attained. Furthermore, the second layer region is constructed such that "the second layer region has a larger degree of crosslinking as compared with that of the first layer region by the second crosslinking agent", which is a part of the configuration of the first aspect of the invention. Therefore, the change of an image can be prevented by inhibiting a swelling of the whole layer even though the ink is supplied to the ink-receiving layer. As a method of manufacturing the recording medium of each of the above aspects of the present invention, there is a method by which the recording medium can be surely manufactured by adopting that "the above pigment is a pigment showing a low viscosity at a comparatively low pH value but it can be changed into a high-viscous pigment at a comparatively high pH value, and the second layer region is formed by applying a coating liquid having a low pH value prepared by dissolving and mixing the pigment, the binder, and the first crosslinking agent on a wet surface having a high pH value and containing the second crosslinking agent".

According to a third aspect of the present invention, there is provided a recording medium having on an ink-recording surface side an ink-receiving layer that contains at least a pigment and a binder for the pigment, the pigment retaining a coloring material of ink and showing a low viscosity at a comparatively low pH value but being changed into a high viscosity at a comparatively high pH, in which the ink-receiving layer includes a first layer region where the binder is cross-linked by a first crosslinking agent having a pH value for retaining the pigment at a low viscosity; and a second layer region in which the binder is cross-linked by a second crosslinking agent having a pH value for retaining the pigment at a high viscosity, and in which the first layer region is located closer to the ink-recording surface side than the second layer region, and the pH of the first layer region is lower than the pH of the second layer region. Therefore, the third aspect of the present invention is similar to the second aspect of the present invention, except for the following. That is, while accelerating the aggregation of the pigment and the crosslinking of the binder by the crosslinking agent utilizing the pigment characteristics, the binding of the cross-linked binder can be attained. Therefore, there is provided an ink-receiving layer in which uniformly-sized pores are formed by the pigment, so that the ink-receiving layer shows a stable osmotic distribution in the direction of thickness to further accelerate an appropriate absorption of ink recorded, while preventing the ink and the coloring material thereof from being dispersed around the ink-absorbed portion in the ink-receiving layer. Consequently, the formation of an extremely clear image can be attained. In Particular, for preventing the loss of the binder in the coating liquid to the coating surface side and attaining an effective removal of a solvent in the coating liquid by use of the reaction rate or reaction conditions at the above liquid-to-liquid contact interface, it is preferable that "the ink-receiving layer is formed by applying a coating liquid on a wet surface, where the coating liquid is prepared by dissolving and mixing at least alumina hydrate as the above pigment and polyvinyl alcohol as the above binder and ortho-boric acid as the above first crosslinking agent for the formation of the first layer region, and the wet surface contains tetraborate as the above second crosslinking agent for forming the above second layer region". Furthermore, for making different degrees of crosslinking, it is more preferable that the content of the ortho-boric acid per unit area in the coating liquid is smaller than the content of sodium tetraborate per unit area in the wet surface and that the pigment is alumina hydrate, the binder is polyvinyl alcohol, the first and second crosslinking agents contain the same boron "B", the content of the boron "B" in the second layer region is twice or more as high as the content of the boron "B" in the first layer region.

According to a fourth aspect of the present invention, there is provided a method of manufacturing a recording medium having an ink-receiving layer that contains a pigment and a binder for the pigment, including a step of applying a coating liquid including the pigment, the binder, and a first crosslinking agent for crosslinking the binder on a wet surface that contains a second crosslinking agent for cross-lining the binder, in which a crosslinking reaction at a contact interface between the coating liquid and the wet surface by the second crosslinking agent is accelerated more than a crosslinking reaction by the first crosslinking agent in the coating liquid. Therefore, according to the fourth aspect of the invention, there is provided a manufacturing method for achieving the above first main object, with which a recording medium can be manufactured which has stable performance by use of the reaction rate or reaction conditions at the liquid-to-liquid contact interface while preventing the loss of the binder in the coating liquid to the coating surface side. As a result, formed is a first layer region in which the binder is cross-linked by the first crosslinking agent and is made uniform relative to the pigment, and a second layer region in which the binder is cross-linked by the second crosslinking agent such that the degree of crosslinking of the binder is higher than that of the first layer region. More preferably, in addition to such a configuration, the second object described above can be achieved by constructing "the method of manufacturing a recording medium in which the pigment is a pigment that shows variations in viscosity depending on pH, and the first crosslinking agent is a crosslinking agent that provides a pH value for retaining the pigment at a high viscosity, where the change of pH is generated at the contact interface to cause the aggregation of pigments and the crosslinking of the binder" to simultaneously restrict the aggregation of the pigments.

According to a fifth aspect of the present invention, there is provided a method of manufacturing recording medium having an ink-receiving layer that contains a pigment showing a low viscosity at a comparatively low pH value and showing a high viscosity at a comparatively high pH value, and a binder for the pigment, including the step of applying a coating liquid on a wet surface, where the coating liquid contains the pigment, the binder, and a first crosslinking agent for crosslinking the binder and shows a low pH value to have the above low viscosity, and the wet surface contains a second crosslinking agent for crosslinking the binder and shows a high pH value to have the above high viscosity. Therefore, the fifth aspect of the invention is to achieve the above first and second objects. In other words, by the relation between the pigment and the first and second crosslinking agent, which constitute the ink-receiving layer, the fifth aspect of the present invention is capable of preventing the loss of the binder in the coating liquid to the coating surface side by use of the reaction rate or reaction conditions at the liquid-to-liquid contact interface, while allowing the change of pH. Thus, the pigment becomes high viscous, and simultaneously the binder becomes cross-linked by a crosslinking agent to result in a rational formation of the second layer region. As a result, the ink recorded in the ink-receiving layer is appropriately absorbed and is prevented from being dispersed around the ink-absorbed portion in the ink-receiving layer, while allowing a uniform distribution of pores. Preferable manufacturing conditions to be added on the fifth aspect of the present invention may be at least one of the following conditions. That is, "the wet surface is a liquid surface prepared by applying a liquid containing the second crosslinking agent on the treated surface of a substrate that constitutes the recording medium, where the treated surface of the substrate is coated with a pre-treatment liquid containing the second crosslinking agent and is then dried and fixed", "the second crosslinking agent is superior in crosslinking reaction to the first crosslinking agent", "the content of the first crosslinking agent per unit area contained in the above coating liquid is lower than the content of the second crosslinking agent per unit area contained in the wet surface", or "the pigment is alumina hydrate, the binder is polyvinyl alcohol, the first and second crosslinking agents contain the same boron "B" and the content of boron in the second layer region is twice or more as high as the amount of "B" contained in the first layer region".

According to a sixth aspect of the present invention, there is provided a method of manufacturing a recording medium having an ink-receiving layer including a first surface-treatment step in which a first coating liquid containing at least one crosslinking agent selected from the group consisting of boric acid and borate is applied and dried for solidification; a second surface-treatment step in which a second coating liquid containing at least one crosslinking agent selected from the group consisting of boric acid and borate is applied on a solidified surface formed by the first surface-treatment step; and a step of applying a third coating liquid containing at least one crosslinking agent selected from the group consisting of a pigment, polyvinyl alcohol, boric acid and borate while the second coating liquid retains a wet condition. Therefore, the present invention according to the sixth aspect provides a specific form for attaining the first object and includes another aspect of the invention for achieving the second object and also achieving the third object in terms of the operations and functions. Here, as preconditions for utilizing the reaction rate or reaction conditions at the liquid-to-liquid contact interface, a uniform liquid surface of the second coating liquid is formed in advance using a solidified surface of the first coating liquid to form the contact interface between the third coating liquid and the second coating liquid more stably.

Preferable conditions to be additionally included in the sixth aspect of the invention may be also added on any of the first to fifth aspects of the invention and other related inventions. For instance, "the pigment contains alumina hydrate, and the weight of the ink-receiving layer is 30 g/m$^2$ or more" or "the method includes the step of casting the ink-receiving layer (each of the ink-receiving layers) obtained after the step of applying the third coating liquid" may be given.

In the above aspects of the present invention, it is preferable to remove any liquid component such as a solvent (e.g., water for PVA, preferably pure water for a countermeasure against contaminant to alumina) from the coating liquid at the time of the above crosslinking reaction or the like. The recording medium may preferably contain as a substrate for supporting the ink-receiving layer, a porous member (e.g., paper, pulp, or porous layer) through which liquid components of the coating liquid can penetrate. In addition, for improving the adherence and the strength of the ink-receiving layer to the substrate (i.e., anchoring effects), it is preferable to form not a uniform surface but a recessed portion for the coating liquid in the wet surface such that the crosslinking of the binder may occur in the recessed portion.

Now, further characteristics of the present invention will be understood upon reading the following description.

DESCRIPTION OF THE PREFERRED EMBODIMENTS

Figure 1:
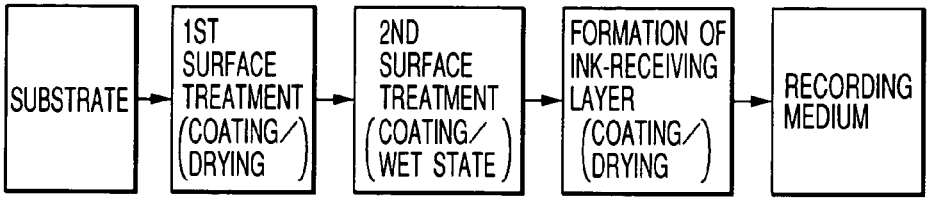
FIG. 1 is a flowchart showing manufacturing steps, except a casting step, in a method of manufacturing a recording medium of the present invention.
Figure 2:
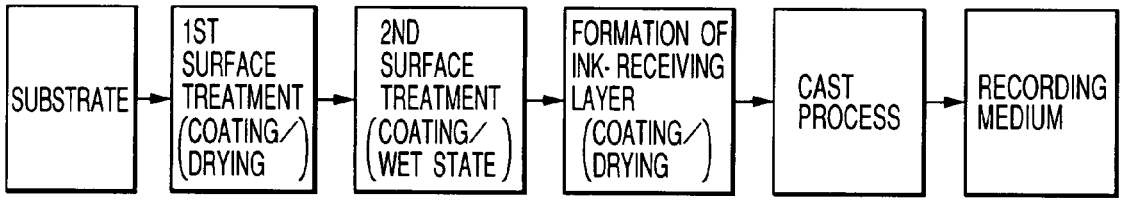
FIG. 2 is flowchart showing manufacturing steps, including the casting step, in the method of manufacturing a recording medium of the present invention.

Hereinafter, the present invention will be described in more detail based on preferred embodiments. Preferable manufacturing processes for a recording medium of the present invention are generally classified into two modes. One of the modes is shown in FIG. 1 in which the process includes two steps of surface-treatment and the step of forming an ink-receiving layer. On the other hand, the other mode is shown in FIG. 2, in which the method of manufacturing a recording medium further includes the step of casting for providing a glossy surface.

A preferable embodiment of the method of manufacturing a recording medium of the present invention will be described at first. The manufacturing method of the present invention shows an excellent productivity while attaining stable characteristics thereof as an appropriate aggregation action of a pigment and an appropriate binding action of a binder are surely obtained at a liquid-to-liquid contact interface while making good use of the conditions of a coating liquid at such an interface and the loss of a binder which should remain in the ink-receiving layer is avoided. The recording medium of the present invention has a novel configuration which can be obtained as a result of securing the binder which should be in the ink-receiving layer. Thus, the ink-receiving layer includes a first layer region in which the binder is made uniform relative to the pigment and a second layer region in which the binder is cross-linked such that the degree of crosslinking becomes larger than that of the first layer region due to the second crosslinking agent to achieve the recording medium in which the first layer region is formed closer to the ink recording surface side than the second layer region.

In the present invention, as the formation of an ink-receiving layer or the final configuration thereof, the binder that constitutes such a layer can be appropriately arranged for the pigment. Thus, pores can be uniformly distributed by the binder and the pigment which are provided by the coating liquid. Simultaneously, a substantial barrier-layer region that prevents the binder provided by the coating liquid from being eliminated is formed under the conditions of high-speed and high-ratio reaction at the liquid-to-liquid contact interface, so that the degree of crosslinking itself can be increased. It is particularly preferable that the above recording medium may have a porous substrate for supporting the above ink-receiving layer. In other words, it may be made of a porous member (e.g., paper, pulp, or porous layer) that allows the penetration of liquid components of the coating liquid because, for removing a solvent in the coating liquid efficiently, it is preferable to eliminate liquid components such as a solvent for dissolving the binder in the coating liquid (e.g., the solvent may be water for dissolving PVA, preferably pure water for a countermeasure against contaminant to alumina) from the coating liquid at the time of the above crosslinking reaction.

In the present invention, the binder exhibits a behavior as a dispersant for dispersing the pigment in the coating liquid. In addition, the binder is located around the pigment to be aggregated after the coating and exhibits a behavior as a binder for binding the pigment while keeping the mixing ratio of the pigment and the binder defined before the coating as far as possible. Typically, such a behavior of the binder utilizes the above liquid-to-liquid contact interface. Consequently, the problem, in which an uniform distribution of the binder has generally occurred in the prior art leads to partially decreased image density as a result of an excess ink absorption and partially decreased image quality as a result of an insufficient ink absorption in a mixed fashion in the ink-receiving layer, can be solved. According to the present invention, a large amount of the binder together with the solvent thereof can be prevented from moving from the coating liquid to the surface to be coated (a target member to be coated) with the coating liquid, so that the binder can be surely cross-linked near the interface between the surface to be coated and the coating liquid. Furthermore, through the use of the thickening and aggregation properties of the pigment (dependency on pH in the case of alumina hydrate described below), the rational pore distribution can be attained by causing the aggregation or thickening of the pigment instead of only the formation of a crosslinked state of the binder. Thus, the surface to be coated can be provided as a uniform and stable surface by conducting the surface-treatment stepwise as described below. More specifically, in the present invention, polyvinyl alcohol (PVA) which is soluble in water (preferably, pure water as a countermeasure against contaminant to alumina) mainly functions as a solute for water in the coating liquid for the formation of an ink-receiving layer. In the coating layer applied, the PVA does not penetrate and disperse together with water, thereby attaining a sudden functional change from the solute to the binder. According to the present invention furthermore, a large amount of ink to be required for the recording operation of a photo printer can be absorbed quickly at high speed. Thus, an ink-receiving layer can be manufactured in a sufficiently stable manner even if such a layer is prepared with a weight of 30 $g/m^2$ or more (corresponding to the thickness thereof after drying). In addition, the binder which functions as a dispersant as well as binder can be controlled in a substantial manner. As a result, a recording medium having excellent ink absorbency and an excellent coloring property can be obtained, and also a method of manufacturing a recording medium, which is excellent in productivity, can be provided.

In a preferable manufacturing method in accordance with the present invention, first and second surface treatments are applied stepwise on a substrate. A coating liquid to be used in the process of the first surface treatment is preferably formed into one having a dry-coating amount, for example, in the range of 0.05 $g/m^2$ or more and 2.0 $g/m^2$ or less, which is expressed in terms of the solid content of borax. If the dry-coating amount of the coating liquid is less than the above range, the viscosity of the coating liquid becomes too low, resulting in the flow of a massive amount of the liquid. On the other hand, if it is higher than the above range, spot-like surface (cast surface) defects tend to occur in the casting step, so that a uniform and excellent glossy surface may be hardly obtained. In the process of the first surface treatment, the coating liquid may be one that contains at least one selected from the group consisting of boric acid and borate, for example an aqueous solution of 5% borax, which is applied on an undercoating layer and is then dried to be solidified. Furthermore, if required, any solvent such as alcohol may be included in the coating liquid for air-release. It is preferable that the dry-coating amount of the coating liquid is as small as possible, so that the rates of the respective steps of coating and drying can be substantially increased, for example, high speed processing at a rate of 50 to 200 meters per minute can be attained.

The process of the second surface treatment (hereinafter, also referred to as a second process) is performed after completing the process of the first surface treatment (hereinafter also referred to as a first process). In the second process, just as in the case of the first process, an additional coating liquid containing at least one selected from the group consisting of boric acid and borate is applied on the substrate on which the surface treatment has been made by the first process. In the second process, in contrast with the first process, the coating liquid is not dried and solidified after the coating. In other words, the surface of the substrate keeps its state of being wet to some degree (or state of the coating liquid or state of being thickened). While keeping such a state, a coating liquid is further applied for a subsequent formation of an ink-receiving layer. At this time, reaction conditions with the liquid-to-liquid contact interface of the present invention are secured. That is, at this interface, the rate of gelation of the coating liquid for the formation of an ink-receiving layer or the rate of crosslinking increases. On the other hand, if the reaction with the liquid-to-liquid contact interface is not obtained, then the binder is dispersed into the pores on the substrate or the surface solidified by the above first surface treatment. As a result, it causes a problem of variations in amount and location of the binder supposed to be responsible for binding the pigment.

The action of the above stepwise surface treatment has the following advantages. In the process of a first surface treatment on the substrate, the coating liquid is dried. Thus, boric acid or borate (hereinafter, referred to as "borate or the like") is located as a solid on the surface of a substrate or in the undercoating layer (the upper portion inside the layer). Furthermore, under such conditions, when the second surface treatment and the formation of the ink-receiving layer are performed, there is an advantage in that in an aqueous solution of boric acid or borate (hereinafter also referred to as "a borate-treating liquid or the like") applied in the process of the second surface treatment, mainly the borate-treating liquid or the like, surely ensures the liquid surface. Therefore, it becomes possible to ensure the liquid-to-liquid contact-mixing between a coating liquid for an ink-receiving layer in the subsequent step and the borate-treating liquid or the like applied in the process of the second surface treatment.

In contrast, when the coating liquid for the ink-receiving layer and the solid of borate or the like are brought into contact with each other, the solid of borate or the like may be dissolved in the coating liquid for the ink-receiving layer even though it will take much time. In this time period, however, the amount of the binder becomes insufficient because of a penetration thereof from the coating liquid into the substrate. Simultaneously, the coating liquid at the portion where the borate or the like has been dissolved exhibits an extremely high concentration as compared with its surroundings, so that a partial gelation or crosslinking proceeds drastically, causing a partial increase in viscosity of the coating liquid. As a result, "the unevenness of the coating" may be caused in the inside and the surface portion of the ink-receiving layer. Thus, a huge-aggregated state (caused by an insufficient amount of the binder) of excess pigments and a binding state by the binder are mixed. As for the ink-receiving layer, it has extreme variation.

With the adoption of such a surface treatment including the above two processes, the substrate on which the solid of the borate or the like is present can be formed while making a wet state thereof by a borate-treating solution or the like more stably. A rapid crosslinking reaction can be obtained on the undercoating layer at the liquid-to-liquid contact interface, so that a solvent such as water in the coating liquid that forms an ink-receiving layer can be removed while separating it from the binder through pores formed in porous members to be formed. Therefore, an appropriate binding can be formed uniformly by an ideal aggregation of the pigments and the existence of the binder. As a result, the generation of cracks by the deficiency of the binder upon manufacturing can be prevented, and the formation of a thick ink-receiving layer with a large dry-coating amount becomes possible.

The above boric acid and borate to be used in the process of the second surface treatment may be the same one used at the time of forming the ink-receiving layer described above or one used in the process of the first surface treatment. Among them, however, it is preferable to use borax particularly in terms of, for example, the rate of gelation or the rate of crosslinking at the stage of forming the ink-receiving layer; variations in viscosity of the coating liquid for the ink-receiving layer to be caused during the usage; and the effects on the ink-receiving layer formed to prevent the generation of cracks in such a layer. In the process of the second surface treatment, it is preferable to adopt such a coating amount for the substrate after the first surface treatment as to avoid the overflow of the coating liquid. Although depending on the absorbency of the substrate after the first surface treatment, when the coating liquid of the second surface treatment is excessively overflowed, there is a possibility of floating the coating liquid for the ink-receiving layer as the coating liquid used in the second surface treatment is overflowed at the time of applying the coating liquid for the ink-receiving layer. As a result, in some cases, the adherence of the ink-receiving layer to the substrate decreases, so that the amount is preferably adjusted.

Furthermore, in the process of the second surface treatment, it is preferable to adjust the solid content concentration of at least one selected from the group consisting of boric acid and borate such that the dry-coating amount of the selected one is in the range of 0.05 to 2.0 g/m$^2$ in terms of the solid borax. In the process of the second surface treatment, the coating liquid that contains at least one selected from the group consisting of boric acid and borate, such as a 5%-borax aqueous solution is used. In addition, the 5%-borax aqueous solution is then applied on an undercoating layer after the first surface treatment. Furthermore, if required, the coating liquid may additionally contain a solvent such as alcohol for air-release.

Furthermore, the dry-coating amount of the coating liquid to be applied in each of the first and second surface treatments can be appropriately determined on the basis of the relation between the first and second surface treatments. For instance, when the coating amount of the coating liquid is reduced in the process of the first surface treatment, it can be complemented with an increased coating amount of the coating liquid in the process of the second surface treatment. In consideration of the easiness of controlling the coating amount of the coating liquid and the relation to the coating amount of the coating liquid in the subsequent process of the second surface treatment, the dry-coating amount of the coating liquid in the process of the first surface treatment is defined in the range of 0.1 to 1.0 g/m$^2$. In consideration of the coating rate and the relation to the coating amount of the coating liquid in the first surface treatment, it is preferable that the dry-coating amount of the coating liquid in the process of the second surface treatment is in the range of 0.3 to 1.5 g/m$^2$. The wet surface described above is not provided as an even surface and has a recessed portion for the coating liquid. The adherence of the ink-receiving layer to the substrate and the anchoring effect can be ensured by generating a crosslinking of the binder in the recessed portion. Thus, it is configured to have the binder cross-linked in the recessed portion, so that it can be also effective configuration for the resulting recording medium. In the preparation of the coating liquid for the ink-receiving layer, it is preferable to use a mixing device. Using such a mixing device, at least one selected from the group consisting of boric acid and borate is mixed with an alumina-hydrate-dispersing solution, and then the resulting mixture is further mixed with an aqueous solution of polyvinyl alcohol as a binder just before the coating to provide a coating liquid. Consequently, it becomes possible to decrease the degree of gelation and to minimize an increase with time in the viscosity of the coating liquid to be generated in the manufacturing process, so that an increase in production efficiency can be realized. The solid content of the pigment in the alumina-hydrate-dispersing solution to be used in the above case may be preferably in the range of 10 to 30% by mass. If it is higher than the above range, the viscosity of the pigment-dispersing solution increases and an increase in the viscosity of the ink-receiving layer is also observed. Therefore, any problem may be caused in the coating ability of the coating liquid.

In the undercoating layer described below and the ink-receiving layer described above, if required, other additives may be appropriately contained. Such other additives include a pigment dispersant, a thickening agent, a fluidity-improving agent, an anti-foaming agent, a foam inhibitor, a mold release agent, a penetrating agent, a coloring pigment, a coloring dye, a fluorescent brightening agent, a UV absorber, an antioxidant, an antiseptic agent, a fungicide, a waterproofing additive, a dye-fixing agent, and so on.

The inventors of the present invention have considered that the formation of an ink-receiving layer in a recording medium may be caused by the following events. At first, for example, by the reaction between boric acid or borate to be used in the surface treatment on the substrate and polyvinyl alcohol in the coating liquid for the ink-receiving layer (i.e., the gelation and/or the crosslinking reaction), (1) the binder in the ink-receiving layer may be distributed in a comparatively uniform manner due to the controlled penetration of the polyvinyl alcohol to the undercoating layer. Furthermore, in the step of drying the coating liquid at the time of forming the ink-receiving layer, (2) the viscosity of the coating layer may increase as the gelation and/or the crosslinking reaction may occur, so that the movement of the coating liquid may be suppressed. In particular, in the case of using alumina hydrate in the materials for forming an ink-receiving layer, the inventors of the present invention have inferred that a crosslinking reaction between alumina hydrate and boric acid or borate should cause a so-called inorganic polymer, and an interaction between boric acid or borate and alumina hydrate and polyvinyl alcohol acts to inhibit the generation of cracks in the ink-receiving layer.

The substrate to be used in the present invention may be one capable of being subjected to a surface treatment described below. For example, although not specifically limited, a fibrous substrate (i.e., a paper substrate) is preferable in the cases of subjecting the recording medium surface to the casting process and forming a glossy surface because water and solvent components are vaporized from the back side of the substrate. The examples of such a paper substrate include those prepared by processing original paper with starch, polyvinyl alcohol, or the like by means of size press, or other coating paper such as art paper, coat paper, and cast-coating paper prepared by making coating layers on the respective original paper.

In the case of forming a glossy surface on the recording medium by subjecting the surface of the recording medium to the casting process, it is preferable to provide the surface of a paper substrate with a coating layer as an undercoating layer of an ink-receiving layer. In this case, the coating layer has a thickness large enough to completely cover cellulose pulp fibers or the texture formation thereof of the paper substrate (original paper). If it is not covered with such a coating layer, an uneven coating (streak-like defect or the like) due to the fibers or the texture formation of the paper substrate tends to be generated in the coating step to form an ink-receiving layer. In this case, cellulose pulp fibers are present in the ink-receiving layer, or in the vicinity of the surface of the ink-receiving layer, or on the surface of the ink-receiving layer. Thus, even if the surface of the recording medium is subjected to the casting process, an excellent and uniform cast surface, i.e., a photo-grade and high-glossy surface can be hardly obtained. For covering the cellulose pulp of the paper substrate, it is preferable that the coating layer has a dry-coating amount of 10 g/m$^2$ or more, more preferably 15 g/m$^2$ more. If the dry-coating amount is less than 10 g m$^2$, it becomes difficult to completely cover the cellulose pulp fibers and the formation of the substrate, so that the glossiness of the recording medium may be affected.

The undercoating layer can be prepared by a coating liquid that contains well-known pigments and binders. Preferably, the undercoating layer may have ink-receiving property. One or more undercoating layers may be formed on at least one side of the substrate. Considering the stability of an environmental curl of the recording medium, the undercoating layer may be preferably formed on both opposite sides of the substrate. The substrate to be used in the present invention may be a paper substrate on which the above undercoating layer is formed. The air permeability of the substrate, which can be measured on the basis of JIS P 8117, is preferably in the range of 1,500 to 5,000 seconds in consideration of: evaporation of water and solvent components from the back side of the substrate in the casting process; the coating property (the wettability) of the coating liquid to be applied on the substrate and the coating property of a material for forming an ink-receiving layer to be formed on the substrate in the first and second surface treatments as described below; and so on. If the air-permeability is below the above range, the denseness of the substrate is low. Thus, the penetration of a crosslinking agent (boric acid or borate in the coating liquid) is high in the first and second surface treatments as described below, so that all of the crosslinking agents may not act thereon effectively. Alternatively, a more coating amount is required. In addition, in the process of the second surface treatment, it is preferable to adopt such a coating amount as to avoid the overflow of the coating liquid. However, it is difficult to adjust the coating amount. It becomes difficult to make a stable coating with time in the whole CD/MD directions.

On the other hand, if the air-permeability of the substrate exceeds the above range, the penetrating property of the coating liquid to be applied in the first and second surface treatments described below is low. In this case, when the coating liquid for the ink-receiving layer is applied on the substrate, the coating liquid for the ink-receiving layer may be floated as a result of the overflow of the coating liquid used in the second surface treatment, or cracks may be generated in the resulting ink-receiving layer even though the amount of such cracks is small. Furthermore, at the time of casting, water and solvent components are hardly evaporated from the back side of the substrate. Thus, a good glossy surface may be hardly obtained. For the same reasons, the substrate may preferably have a Stöckigt sizing degree of 100 to 400 seconds, and a Bekk smoothness of 100 to 500 seconds. For obtaining a recording medium having the same high quality as that of a silver salt photograph, a basis weight of the substrate may be preferably in the range of 160 to 230 g/M$^2$ with a Gurley stiffness (J. Tappi No. 40, long grain) of 7 to 15 mN.

Here, materials used for the formation of an ink-receiving layer to be used in the present invention will be described. The ink-receiving layer can be formed by applying a coating liquid that contains a pigment and a binder. It is preferable that the pigment may contain, in particular, alumina hydrate as a main component in terms of dye fixability, transparency, printing density, color development, and glossiness. Alternatively, the following pigments may be used. For instance, inorganic pigments include light calcium carbonate, heavy calcium carbonate, magnesium carbonate, kaolin, aluminum silicate, diatomaceous earth, calcium silicate, magnesium silicate, synthetic amorphous silica, colloidal silica, alumina, magnesium hydroxide, and so on. In addition, organic pigments include styrene plastics pigment, acrylic plastics pigment, polyethylene particle, microcapsule particle, urea resin particle, melamine resin particle, and so on.

As the alumina hydrate, for example, one represented by the following general formula (1) may be preferably used.

$$Al_2O_3\text{-}n\ (OH)_{2n}.mH_2O$$

(wherein, n denotes any one of 0, 1, 2, and 3, m denotes a value within 0 to 10, preferably 0 to 5, but m and n are not simultaneously set to 0. In many cases, $mH_2O$ represents a removable water phase not related to the formation of a crystal lattice, so that m is an integer number or is a number other than integer. Alternatively, m may reach the value of 0 when this kind of the material is heated).

The alumina hydrate can be generally prepared, for example, by one of the method of hydrolyzing aluminum alkoxide or hydrolyzing sodium aluminate as described in U.S. Pat. No. 4,242,271 B and U.S. Pat. No. 4,202,870 B, and the method of neutralizing by adding an aqueous solution such as aluminum sulfate or aluminum chloride into an aqueous solution of sodium aluminate as described in JP 57-447605 B. A preferable alumina hydrate to be used in the present invention is aluminum hydrate exhibiting a boehmite structure or an amorphous structure by an analysis using an X-ray diffraction method. In particular, aluminum hydrate described in JP 7-232473 A, JP 8-132731 A, JP 9-66664 A, JP 9-76628 A, and so on may be used.

In the case of performing a casting process by making the ink-receiving layer into a wet condition by means of a rewet method for making the surface of the recording medium glossy, a plate-like alumina hydrate having the tendency of being oriented may be preferably used. The plate-like alumina hydrate has good water absorbency, so that a re-wetting liquid easily tends to penetrate. Thus, the ink-receiving layer becomes swell to easily cause the rearrangement of alumina hydrate particles. As a result, high glossy properties can be attained. In addition, a re-wetting solution can effectively penetrate. Thus, the productive efficiency increases at the time of casting.

In the present invention, polyvinyl alcohol is used for the binder which is used in the coating liquid for the ink-receiving layer. The content of the polyvinyl alcohol may be preferably in the range of 5 to 20% by mass with respect to alumina hydrate. In the present invention, the binder to be used in the formation of ink-receiving layer may be a conventional binder to be used in combination with the above polyvinyl alcohol.

In the material for the formation of the ink-receiving layer to be descried above, it is extremely effective for the formation of the ink-receiving layer to contain at least one selected from the group consisting boric acid and borate. The borates which can be used in this case include not only ortho-boric acid ($H_3BO_3$) but also meta-boric acid, and diboric acid. In addition, it is preferable that the borate may be an aqueous salt of the above boric acid. More specifically, the borates include, for example, alkali metal salts such as Na-salts of boric acid (e.g., $Na_2B_4O_7.10H_2O$ and $NaBO_2.4H_2O$) and potassium salts (e.g., $K_2B_4O_7.5H_2O$ and $KBO_2$), ammonium salts of boric acid (e.g., $NH_4B_4O_9.3H_2O$ and $NH_4BO_2$), and alkaline earth metal salts such as the magnesium salts of boric acid and calcium salts of boric acid.

In terms of the stability of the coating liquid with time and the inhibition effect on the generation of cracks, ortho-boric acid is preferably used. In addition, the amount of the ortho-boric acid to use is preferably in the range of 1.0 to 15.0% by mass (the solid content of boric acid) with respect to the polyvinyl alcohol in the ink-receiving layer. In this range, however, the crack may sometimes occur depending on the manufacturing conditions or the like, so that there is a need of selecting the manufacturing conditions. In addition, if the value is higher than the above range, it is not preferable because the stability of the coating liquid with time decreases. That is, the coating liquid is used for a long time during the manufacture. If the content of boric acid is high, an increase in viscosity of the coating liquid, or the generation of a gelated production can occur during the manufacture. Therefore, it becomes necessary to frequently exchange the coating liquid with a new one, cleaning a coater head, or the like. As a result, productivity can be notably decreased. Furthermore, if the value exceeds the above range, due to the same reasons as those of the first and second surface treatments, dot-like surface (cast surface) detects tend to occur in the casting process, so that a uniform and excellent glossy surface may not be obtained.

The ink-receiving layer formed as described above attains the objects and effects with respect to high ink absorbency and high fixing property when the pore physical properties satisfy the following conditions. At first, the pore volume of the ink-receiving layer is preferably in the range of 0.1 to 1.0 $cm^3/g$. That is, if the pore volume does not satisfy the above range, a sufficient ink absorbing property cannot be obtained, which results in an ink-receiving layer having poor ink absorbency. As the case may be, there is a possibility of causing the overflow of ink and the generation of bleeding in an image. On the other had, when it is above such a range, there is a tendency of causing cracks and powder falling in the ink-receiving layer. In addition, preferably, the ink receiving layer may have a BET specific surface area of 20 to 450 $m^2/g$. If it is below the above range, sufficient glossiness may not be acquired and haze increases (transparency falls), so that there is a possibility that white mist may be on an image. In this case, furthermore, there is also a possibility of causing a decrease in adherence of the dye in the ink undesirably. On the other hand, if the above range is exceeded, it is not preferable because cracks are easily generated in the ink-receiving layer. Furthermore, the pore volume and the BET specific surface area are calculated by the nitrogen adsorption and desorption method.

Furthermore, in the case of forming the ink-receiving layer, the application of the manufacturing method of the present invention allows an increase in the degree of freedom compared with the conventional one with respect to a thickness of the ink-receiving layer. In other words, it becomes possible to increase the thickness more than before. Considering a high ink absorbency, it is preferable to use the amount of dry coating in the range of 30 to 50 $g/m^2$. If it is below the above resin, in particular, a sufficient ink absorbency cannot be attained when a printer such as one having a plurality of light color inks in addition to black ink and three colors of cyan, magenta, and yellow. That is, it is not preferable because the overflow of ink may be generated and sometimes the bleeding may occur. In this case, furthermore, the ink dye may be dispersed up to the substrate, and the printing density may be decreased. On the other hand, if it exceeds the above range, there is a fear that the development of cracks cannot be absolutely avoided. Furthermore, if the value is larger than 30 $g/m^2$, it is preferable in that an ink-receiving layer that shows a sufficient ink absorbency even under high-temperature and high-humidity circumferences. If the dry-coating amount is 50 $g/m^2$ or less, it becomes difficult to cause an uneven coating, so that the ink-receiving layer having a stable thickness can be obtained.

Boric acid or borate, which is contained in a coating liquid to be used in the process of the first or second surface treatment of the present invention, is the same one as that used for the material for forming the ink-receiving layer. In particular, in terms of prevention of the generation of cracks, it is preferable to contain sodium tetraborate (borax).

Coating of each coating liquid for the above ink-receiving layer and the surface treatment step is performed for obtaining an appropriate coating amount as described above, for instance, by appropriately selecting the device from among various kinds of coating devices including various blade coaters, roll coaters, air knife coaters, bar coaters, rod blade coaters, curtain coaters, gravure coaters, coaters using an extrusion method, coaters using a slide hopper method, and size press coaters, through on-machine or off-machine coating. At the time of coating, for adjusting the viscosity or the like of the coating liquid, the coating liquid may be heated, or the coater head may be heated.

For drying after the coating, for example, a hot air drier such as a linear tunnel drier, an arch drier, an air-loop drier, and a sine-curve air float drier, and also a drier such as a drier using infrared rays, a heating drier, and a drier using a microwave can be suitably chosen and used.

After forming the ink-receiving layer as described above, a glossy surface can be formed on the surface of the ink-receiving layer using the casting method. Such a forming method will be described below.

The casting method is a method that includes pressing the ink-receiving layer in a wet state or in a state of having plasticity onto a heated-mirror drum (cast drum) surface, drying the layer being pressed onto the drum surface, and copying the mirror surface of the drum onto the surface of the ink-receiving layer. Typically, there are three kinds of casting methods known in the art, i.e., a direct method, a rewet method (indirect method), and a solidifying method.

Each of these casting methods can be used in the present invention. However, as described above, in the present invention, it is preferable to use alumina hydrate in the ink-receiving layer of the recording medium. In this case, particularly, high glossiness can be obtained using a rewet-casting method as the more preferable ones.

The method of manufacturing a recording medium of the present invention may further include the step of forming a back side layer on the back side of the substrate (the side opposite to the side on which an ink-receiving layer is formed) to form a recording medium having the back side layer. The formation of such a back side layer is effective to reduce the generation of curl before or after printing.

Considering the effect of inhibiting the generation of curl, it is preferable that the back side layer may exhibit shrinkage similar to the undercoating layer formed on the substrate surface side and/or the ink-receiving layer upon the moisture-absorption. These layers may be used together with the pigment and the binder of the same system. In particular, it is preferable to use a pigment and a binder which are of the same system as the material for forming the thick ink-receiving layer. The formation of the back side layer may be performed before or after the first surface treatment, after the formation of the ink-receiving layer, or after the cast process.

Furthermore, in the process of manufacturing the recording medium of the present invention, if required, an additional layer such as the undercoating layer described above may be formed between the back side layer and the substrate. In this case, furthermore, a glossy surface may be also formed on the back side, to thereby obtain a recording medium having glossy surfaces on the opposite sides, respectively. In addition, if the printing performance is imparted to the back side layer, or the back side layer and/or another layer, double-sided printing can be performed.

Figure 3:
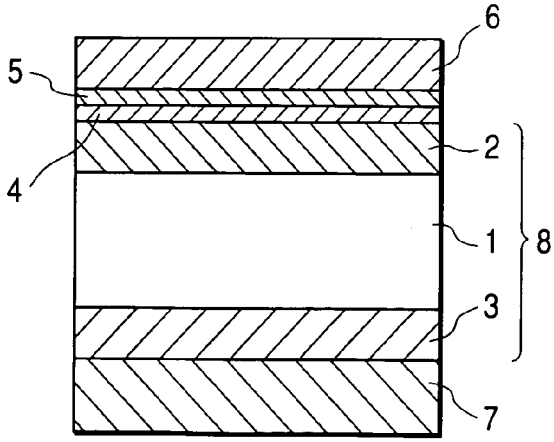
FIG. 3 is an explanatory diagram showing a recording medium manufactured by the method of manufacturing a recording medium of the present invention.

Furthermore, the back side layer may be formed as follows. That is, for preventing the generation of cracks, as in the ink-receiving layer, the back side of the substrate is subjected to the first surface treatment, the second surface treatment, and the formation of the back side layer (i.e., the second surface treatment is performed after the first surface treatment). Subsequently, a coating liquid for the back side layer is applied while keeping the substrate in a wet state, followed by drying. However, in some cases (depending on the state of crack generation on the back side layer), it may be sufficient to perform only one of the first and second surface treatments. The configuration of the recording medium to be manufactured as described above is represented by a schematic cross-sectional diagram as shown in FIG. 3 as one of preferred embodiments. That is, the recording medium includes an original paper 1, an undercoating layer 2 containing a pigment, a binder, and so on, an undercoating layer 3, a surface treatment 4 by coating with a coating liquid containing borax and drying, a surface treatment 5 by coating with a coating liquid containing borax, an ink-receiving layer 6 (containing alumina hydrate, polyvinyl alcohol, boric acid, and so on) prepared through coating and drying while keeping the undercoating layer and the original paper in a wet state by the surface treatment, and a back side layer 7 containing a pigment and a binder. The original paper 1 and undercoating layers 2 and 3 constitute a substrate 8.

In the recording medium with reference to FIGS. 1 and 2, there is provided a recording medium in which the ink-receiving layer includes: a first layer region where the binder is cross-linked by a first crosslinking agent to become uniform relative to the pigment; and a second layer region where the binder is cross-linked by a second crosslinking agent such that the degree of crosslinking of the second layer region is larger than that of the first layer region, and in which the first layer region is located closer to the ink-recording surface side than the second layer region. This is a novel recording medium capable of preventing the loss of the binder described above while stably forming pores caused by the pigment aggregated in the second layer region by means of the crosslinked binder having a large degree of crosslinking. Accordingly, the ink recorded in the ink-receiving layer can be appropriately absorbed, and a clear image formation can be attained without causing the distribution of ink around the ink-absorbed portion in the ink-receiving layer.

The degree of crosslinking in the second layer region substantially strengthens the crosslinking of the binder, so that the state of binder distribution at the interface can be made uniform with no excess concentration or excess shortage. As a result, the binder itself can be prevented from making useless passage. In particular, if the interface is uneven (with concave and convex) an anchoring effect of the binder can be expected. The above degree of crosslinking is determined by the relative numerical quantity difference or numerical quantity ratio (e.g., 2 folds or more) between the common element (e.g., boric acid "B") contained in the first and second crosslinking agents and the common element of the first and second layer regions. As a specific material and a specific manufacturing method therefor, a coating liquid is used, which is prepared by dissolving and mixing alumina hydrate as the above pigment, polyvinyl alcohol as the above binder, and ortho-boric acid as the above first crosslinking agent. Then, a recording medium is prepared by applying the coating liquid on a wet surface that contains sodium tetraborate as the second crosslinking agent for the formation of the second layer region. Furthermore, in the coating liquid, there is provided a practical example in which the content of the ortho-boric acid per unit area is smaller than the content of the sodium tetraborate per unit area in the wet surface.

Here, there is provided a recording medium having on an ink-recording surface side an ink-receiving layer that contains at least a pigment retaining a coloring material of ink and showing variations in viscosity depending on pH and a binder for the pigment, in which the ink-receiving layer includes a first layer region where the binder is cross-linked by a first crosslinking agent having a pH value for retaining the pigment at a low viscosity; and a second layer region in which the binder is cross-linked by a second crosslinking agent having a pH value for retaining the pigment at a high viscosity, and in which the first layer region is located closer to the ink-recording surface side than the second layer region. This means that the relation between the pigment and the first and second crosslinking agents which constitute the ink-receiving layer causes variations in pH to make the pigment highly viscous and concurrently the crosslinking agent cross-links the binder, resulting in a rational formation of the second layer region. As a result, the formation of an excellent pore distribution and the binder cross-linked without loss allow an appropriate absorption of ink recorded in the ink-receiving layer, while preventing the ink and the coloring material thereof from being dispersed around the ink-absorbed portion in the ink-receiving layer. Consequently, the formation of a clearer image can be attained. Furthermore, since the second layer region is constructed such that the second layer region has a larger degree of crosslinking as compared with that of the first layer region by means of the second crosslinking agent, even though the ink is supplied to the ink-receiving layer, swelling of the whole layer can be inhibited, thereby preventing the change of an image. As a method of manufacturing the recording medium, there is a method by which the recording medium can be surely manufactured by adopting that "the above pigment is a pigment showing a low viscosity at a comparatively low pH value but it can be changed into a high-viscous pigment at a comparatively high pH value, and the second layer region is formed by applying a coating liquid having a low pH value prepared by dissolving and mixing the pigment, the binder, and the first crosslinking agent on a wet surface having a high pH value and containing the second crosslinking agent".

The recording medium, in which the first layer region is located closer to the ink-recording surface side than the second layer region, and the pH of the first layer region is higher than the pH of the second layer region, is similar to that according to the second aspect of the present invention, except for the following points. That is, while accelerating the crosslinking of the binder by the crosslinking agent and the aggregation of the pigment utilizing the pigment characteristics, binding of the cross-linked binder can be attained. Therefore, provided is an ink-receiving layer in which uniform-sized pores are formed by the pigment, so that the ink-receiving layer shows a stable osmotic distribution in the direction of thickness to further accelerate an appropriate absorption of ink recorded, while preventing the ink and the coloring material thereof from being dispersed around the ink-absorbed portion in the ink-receiving layer. Consequently, the formation of an extremely clear image can be attained. In particular, for preventing the loss of the binder in the coating liquid to the coating surface side and attaining the effective removal of a solvent in the coating liquid by use of the reaction rate or reaction conditions at the above liquid-to-liquid contact interface, it is preferable that "the ink-receiving layer is formed by applying a coating liquid on a wet surface, where the coating liquid is prepared by dissolving and mixing alumina hydrate as the above pigment, polyvinyl alcohol as the above binder, and ortho-boric acid as the above first crosslinking agent, and the wet surface contains tetraborate as the above second crosslinking agent". Furthermore, for making different degrees of crosslinking, it is more preferable that the content of the ortho-boric acid per unit area in the coating liquid is smaller than the content of sodium tetraborate per unit area in the wet surface, and that the pigment is alumina hydrate, the binder is polyvinyl alcohol, the first and second crosslinking agents contain the same boron "B", and the content of the boron "B" in the second layer region is twice or more as high as the content of the boron "B" in the first layer region.

The method of manufacturing a recording medium shown in FIGS. 1 and 2 includes the step of applying a coating liquid including the pigment, the binder, and a first crosslinking agent for crosslinking the binder on a wet surface that contains a second crosslinking agent for crosslinking the binder, thereby accelerating a crosslinking reaction at a contact interface between the coating liquid and the wet surface by the second crosslinking agent more than a crosslinking reaction by the first crosslinking agent in the coating liquid. Therefore, a recording medium having stable performance by use of the reaction rate or reaction conditions at the liquid-to-liquid contact interface while preventing the loss of the binder in the coating liquid to the coating surface side can be manufactured. As a result, formed in the ink-receiving layer is a first layer region in which the binder is cross-linked by the first crosslinking agent and is made uniform relative to the pigment, and a second layer region in which the binder is cross-linked by the second crosslinking agent such that the degree of crosslinking of the binder is higher than that of the first layer region. More preferably, in addition to such a configuration, the aggregation of pigments can be simultaneously restricted by constructing "the method of manufacturing a recording medium, in which the pigment is a pigment that shows variations in viscosity depending on pH, and the first crosslinking agent is a crosslinking agent that provides a pH value for retaining the pigment at a high viscosity; and the change of pH is generated at the contact interface to cause the aggregation of pigments and the crosslinking of the binder". Here, the following conditions are effected. That is, "the second crosslinking agent is superior in crosslinking reaction to the first crosslinking agent", "the content of the first crosslinking agent per unit area in the above coating liquid is lower than the content of the second crosslinking agent per unit area in the wet surface", or "the pigment is alumina hydrate, the binder is polyvinyl alcohol, the first and second crosslinking agents contain the same boron "B" and the content of boron "B" in the second layer region is twice or more as high as the amount of boron "B"contained in the first layer region".

In the above aspects of the present invention, it is preferable to remove any liquid component such as a solvent for dissolving the binder in the coating liquid (e.g., water for PVA, preferably pure water for a countermeasure against contaminant to alumina) from the coating liquid at the time of the above crosslinking reaction or the like. The recording medium may preferably contain a porous member (e.g., paper, pulp, or porous layer) through which liquid components of the coating liquid can penetrate as a substrate for supporting the ink-receiving layer. In addition, for improving the adherence and the strength of the wet surface to the substrate of the ink-receiving layer (i.e., anchoring effects), it is preferable to form not a uniform surface but a recessed portion for the coating liquid in the wet surface such that the crosslinking of the binder may occur in the recessed portion.

EXAMPLES

Hereinafter, the present invention will be described in more detail based on examples and comparative examples. However, the present invention is not limited to those examples.

At first, a method of measuring various physical properties used in the present invention and a method of evaluating them will be explained.

<Stöckigt Sizing Degree>

The recording medium was cut into sheets in A4 size, and each of five sheets among them was left for 2 hours or more under the conditions of an atmospheric temperature of 23° C. and a humidity of 50% of humidity, and after that, based on JIS P8122, Stöckigt sizing degree was measured for every sheet, and was then calculated as the average of five sheets.

<Air Permeability>

Five sheets of the recording medium were left under the same conditions as those of the measurement of Stöckigt sizing degree. After that, the measurement of air permeability was conducted for every sheet according to JIS P8177. From the resulting values, the average value of five sheets was calculated.

<Bekk Smoothness>

Five sheets of the recording medium were left under the same conditions as those of the measurement of Stöckigt sizing degree. After that, the measurement of Bekk smoothness was conducted for every sheet according to JIS P8119. From the resulting values, the average value of five sheets was calculated.

<Gurley Stiffness>

Five sheets of the recording medium were left under the same conditions as those of the measurement of Stöckigt sizing degree. After that, the measurement of Gurley stiffness in the direction of long grain was conducted for every sheet according to J. Tappi No. 40. From the resulting values, the average value of five sheets was calculated.

<BET Specific Surface Area and Pore Volume>

After sufficiently carrying out the heat deaeration of the alumina hydrate, BET specific surface area and pore volume were measured using a device (Autosorb-1 (trade name) commercially available from Quantachrome Instruments) based on the well-known nitrogen adsorption and desorption method.

The BET specific surface area was calculated according to the method of Brunauer et al.(see J. Am. Chem. Soc., vol. 60., 309, 1938).

The pore volume was calculated according to the method of Barrett et al. (see J. Am. Chem. Soc., vol. 73, 373, 1951).

<Generation of cracks>

The recording medium was cut into sheets in A4 size and visual observation was performed for each of five sheets. A four-rank evaluation was performed on the results of the visual observation.

The evaluation criteria are as follows.

4: Excellent because the generation of cracks is not found at all.

3: The generation of cracks is slightly observed.

2. The generation of cracks is observed more than the evaluation 3.

1. The generation of a large number of cracks is observed.

<Image Density>

Using a printer (trade name: BJF 900 manufactured by Canon Co., Ltd.), a black color is printed to prepare a 100% print section of 3 cm square. Then, the print section was subjected to the measurement of image density using the Macbeth reflection density meter (trade name: RD-918, Kollmorgen Corporation Co., Ltd.).

<Glossiness>

According to JIS Z8741, relative-specular glossiness at 20° was measured using a gloss meter (trade name: VG2000, manufactured by Nippon Denshoku Kogyo, Co., Ltd.)

<Ink Absorbency>

Using a printer (trade name: BJF 900 manufactured by Canon Co., Ltd.), each primary color of yellow, magenta, cyan, and black was printed to prepare a 100% print section of 3 cm square. In addition, each secondary color of red (a secondary color between 100% yellow and 100% magenta), blue (a secondary color between 100% magenta and 100% cyan), and green (a secondary color between 100% yellow and 100% cyan) was printed to prepare a 100% print section of 3 cm square. Then, each print section was visually examined by visual observation and feeling with hand. The results were evaluated according to the four-rank evaluation as follows.

4. Immediately after printing, ink does not adhere to a finger in all of the secondary color images.
3. Immediately after printing, there is an extremely small amount of ink being overflowed by the secondary color image. However, the ink is absorbed for a short period of time. In addition, no ink is adhered on a finger in all of the monochrome images immediately after printing.
2. Immediately after printing, there is a little amount of ink being overflowed by the secondary color image. However, the ink is absorbed even though it takes much time, compared with the evaluation 3. In addition, no ink is adhered on a finger in all of the monochrome images immediately after printing.
1. Immediately after printing, ink is adhered on a finger in all of the monochrome images.

<Surface Property>

Surfaces of five sheets of ink-receiving layers were visually observed and a three-rank evaluation was made on observations. The evaluation criteria are as follows.

3: Uniform feeling and excellent quality.

2: Coating unevenness or minute defects can be observed depending on the angle of visual observation.

1: Distinguished coating unevenness or more minute defects can be observed, compared with the evaluation 2.

Example 1

At first, a substrate was prepared as follows. In a pulp slurry having 80 parts by mass of an least bleached kraft pulp (LBKP) with a freeness of 450 ml CSF (Canadian Standard Freeness) and 20 parts by mass of an needle bleached kraft pulp (NBKP) with a freeness of 480 ml CSF, 0.60 parts by mass of cationized starch, 10 parts by mass of heavy calcium carbonate, 15 parts by mass of light calcium carbonate, 0.10 parts by mass of alkyl ketene dimer, and 0.03 parts by mass of cationic polyacrylamide were added to adjust the pulp. Then, the pulp was milled with a Fourdrinier machine and was then subjected to a 3-stepped wet press, followed by drying with a multi-tube drier. Then, the pulp was subjected to a size press device and was then immersed in an oxidized starch aqueous solution to have a solid content of 1.0 g/m$^2$. After drying, machine calendering was carried out, resulting in a substrate having a basis weight of 155 g/m$^2$, a Stöckigt sizing degree of 100 seconds, an air-permeability of 50 seconds, a Bekk smoothness of 30 seconds, and a Gurley stiffness of 11.0 mN.

Next, an undercoating layer was formed on the substrate as described above in the following manner. A coating liquid to be used for the formation of the under coating layer was prepared as a composition by adding 7 parts by mass of commercially-available styrene-butadiene latex in a slurry (70% in solid content) having 100 parts by mass (loading weight) of kaolin (trade name: Ultra White 90, manufactured by Engelhard Co., Ltd.)/zinc oxide/aluminum hydroxide (at a weight ratio of 65/10/25) and 0.1 parts by mass of a commercially-available polyacryl dispersant such that the resulting composition was adjusted to have a solid content of 60%. Then, the composition was applied on both sides of the substrate using a blade coater so as to have a dry-coating amount of 15 g/m$^2$ and was then dried. Subsequently, the dried composition was subjected to a machine calendaring (linear loads of 150 kgf/cm), resulting in a substrate having an undercoating layer and having a basis weight of 185 g/m$^2$, a Stechkigt sizing degree of 300 seconds, an air-permeability of 3,000 second, a Bekk smoothness of 200 seconds, and a Gurley stiffness of 11.5 mN. The whiteness of the substrate having the undercoating layer was measured for each of 5 samples in A4 size prepared by cutting the substrate into sheets. Then, an average was obtained. As a result, L*:95, a*:0, b*:−2 was obtained (i.e., obtained as color hue of JIS Z 8729).

The undercoating layer obtained as described above was further subjected to a surface treatment including the following first and second steps. At first, in the first surface treatment step, a 5%-borax aqueous solution warmed at 30° C. was used as a coating liquid. Then, the coating liquid was applied on the undercoating layer using a gravure coater at a rate of 60 m/m so as to attain a dry-coating amount of 0.4 g/m$^2$. After that, the coating liquid was dried and solidified at 60° C.

Next, in the process of the second surface treatment, a coating liquid was prepared just as in the case of the process of the first surface treatment. Thus, a 5%-borax aqueous solution heated at 30° C. was used as the coating liquid and was then applied on the undercoating layer using an air-knife coater at a rate of 30 meters per minute so as to attain a wet coating amount of 10 g/m$^2$ (0.5 g/m$^2$ when dried). According to the visual observation, the coating amount corresponded to the amount in which the coating liquid prepared by the second surface treatment was just in a state of being impregnated in the undercoating layer such that the coating liquid was not overflowed.

Subsequently, an ink-receiving layer was formed. After the coating in the process of the second surface treatment, that is, immediately after the coating liquid is impregnated into the undercoating layer, an ink-receiving layer is formed on the undercoating layer without change. In this case, the coating liquid, the coating method, and so on used for the formation of the ink-receiving layer are as follows.

As alumina hydrate A, Disperal HP13 (trade name, manufactured by Sasol Co., Ltd.) was dispersed in water (preferably, pure water for a countermeasure against contaminant to alumina) so as to be 5% by mass in solid content. Then, hydrochloric acid was added in the alumina hydrate A to adjust pH to 4, and the mixture was stirred for a while. After that, the resulting dispersant was heated up to 95° C. with stirring and was then kept at such a temperature for 4 hours. Subsequently, the pH of the dispersant was adjusted to 10 with caustic soda, while keeping the temperature, followed by stirring for 10 hours. After the stirring, the dispersant was cooled to a room temperature and pH was then adjusted to 7 to 8. Furthermore, the dispersant was subjected to desalination, followed by the addition of acetic acid to allow a deaggregation treatment to obtain a colloidal sol. The colloidal sol was dried to obtain alumina hydrate B. The alumina hydrate B was subjected to the measurement using an X-ray diffraction. As a result, it was revealed that the alumina hydrate B had a boehmite structure (pseudo boehmite). In addition, the BET specific surface areas at this time were 143 g/m$^2$, the pore volume was 0.8 cm$^3$/g, and it had a plate-like shape in observation with an electron microscope.

On the other hand, polyvinyl alcohol (trade name: PVA117, manufactured by Kuraray, Co., Ltd.) was dissolved in water (preferably, pure water for a countermeasure against contaminant to alumina) to obtain an aqueous solution of 9% by mass of solid content. Then, the colloidal sol of alumina hydrate B prepared in the above was condensed to prepare 22.5% by mass of a dispersant. Subsequently, a 3%-boric acid aqueous solution was added in the dispersant so as to attain 0.50% by mass with respect to the solid content of the alumina hydrate B in terms of the solid content of boric acid. After that, the resulting alumina hydrate dispersant containing boric acid was mixed with a polyvinyl alcohol aqueous solution previously prepared by a static mixer such that the ratio of solid contents between the alumina hydrate and the polyvinyl alcohol becomes 100:8. Just after the mixing, it was provided as a coating liquid for the ink-receiving layer and was then applied with a dye coater at a rate of 30 meters per minute so as to attain a dry-coating amount of 35 g/m$^2$. Following that, it was dried at 170° C. to form an ink-receiving layer.

Next, a back side layer was formed on the undercoating layer on another side of the substrate, which was opposite to the ink-receiving layer. In this case, as alumina hydrate, Disperal HP13/2 (trade name, manufactured by Sasol Co., Ltd.) was dispersed in water (preferably, pure water for a countermeasure against contaminant to alumina) so as to have a solid content of 18% by mass, followed by being centrifuged. The resulting dispersant and the same polyvinyl alcohol aqueous solution as one used in the formation of the ink receiving layer were mixed together with a static mixer such that the ratio between the alumina hydrate solid content and the polyvinyl alcohol content becomes 100:9. Immediately after mixing, the resulting coating liquid was applied by the dye coater at a rate of 35 meters per minute so as to attain a dry-coating amount of 23 g/m$^2$. Then, the coating liquid was dried at 170° C., and the back side layer is formed to obtain a recording medium of this example.

Here, the content of boron "B" in the first layer region was $2.61\times10^{-3}$ mol/m$^2$, and also the content of boron "B" in the second layer region was $9.94\times10^{-3}$ mol/m$^2$. Thus, the content of boron "B" in the second layer region was 3.8 times higher than that of the first layer region. Furthermore, the content of boron "B" in the first layer region was calculated from the following equation.

(Dry-coating amount of ink-receiving layer: 35)×(amount of boric acid:22.5×0.5%)/{amount of boric acid: 22.5×0.5%)+(amount of PVA: 22.5×8/100)+(amount of alumina hydrate: 22.5)}=0.16 g/m$^2$ 0.16/(molecular weight of 1 mol of boric acid: 61.8)=$2.61\times10^{-3}$ mol/m$^2$ In addition, the content of boron "B" in the second layer region was calculated from the following equation.

{(Dry-coating amount of the second surface treatment:0.5)/(molecular weight of 1 mol of borax: 201.2)}×(number of moles of B per mole of borax: 4)=$9.94\times10^{-3}$ mol/m$^2$.

Here, the molecular weight of 1 mol of borax was calculated such that the borax was in a state of being impregnated with respect to the undercoating layer, that is, was not in a dry state and thus, borax was regarded as $Na_2B_4O_7$.

Example 2

A glossy surface was formed on the surface of the ink-receiving layer of Example 1 by a rewet cast method. At first, water provided as a re-wetting solution was applied uniformly on the whole cloth to wet the ink-receiving layer. Keeping such a wet state, the ink-receiving layer was pressed against a cast drum having a mirror surface heated at 100° C. followed by drying at a rate of 30 meters per minutes to obtain a recording medium of this example. The glossiness of the ink-receiving surface was 32%.

Example 3

A recording medium of this example was obtained in the same way as that of Example 1 except that an ink-receiving layer containing silica was prepared as described in below instead of the ink-receiving layer containing alumina hydrate, which was prepared in Example 1. The composition to be used in a coating liquid for an ink-receiving layer was constructed of: 100 parts by weight of cationic colloidal silica (trade name: Snowtex AK-ZL, manufactured by Nissan Chemical Industry Co., Ltd.) having an average particle size of 80 nm; 3 parts by weight of commercially available nonionic acryl emulsion; and 7 parts by weight of polyvinyl alcohol which was the same one as that of Example 1. This composition was adjusted so as to attain a solid content concentration of 25%, and was then applied with a roll coater so as to attain a dried coating amount of 30 $g/m^2$followed by drying. Other steps were conducted in the same way as that of Example 1. Consequently, a recording medium of this example was obtained.

Example 4

A recording medium of this example was prepared by the same way as that of Example 1 except that the alumina hydrate used in Example 1 was changed to the following alumina hydrate C.

Alumina hydrate C: At first, aluminum dodexide was prepared by the method described in U.S. Pat. No. 4,242,271. Then, aluminium dodexide described above was hydrolyzed by the method described in U.S. Pat. No. 4,202,870 to obtain alumina slurry. Subsequently, water was added to the alumina slurry up to a solid content of alumina hydrate of 7.9%. The pH of the alumina slurry was 9.5. Then, the pH of the alumina slurry was adjusted by the addition of a 3.9% nitric acid solution. The alumina slurry was heated and incubated in an autoclave to obtain the following physical properties. The resulting colloidal sol was subjected to spray drying at 75° C. to form alumina hydrate C. This alumina hydrate C was analyzed using the X-ray diffraction, and was found to be amorphous. At this time, the BET specific surface area was 195 $g/m^2$, the pore volume was 0.75 $cm^3/g$, and the recording medium was a plate-like in observation with an electron microscope.

Example 5

A recording medium was obtained in the same way as that of Example 1 except that the process of the first surface treatment in Example 1 was not conducted.

Comparative Example 1

A recording medium was obtained in the same way as that of Example 1 except that the process of the second surface treatment in Example 1 was not conducted.

Comparative Example 2

A recording medium was obtained in the same way as that of Example 1 except that the process of neither the first nor second surface treatment in Example 1 was conducted.

Comparative Example 3

A recording medium was obtained in the same way as that of Example 1 except that the coating liquid containing borax was dried and solidified at 60° C. in the process of the second surface treatment of Example 1.

The recording media obtained in Examples 1 to 5 and Comparative Examples 1 to 3 was evaluated by the methods and the evaluation criteria described above, respectively. The results were listed in Table 1.

TABLE 1

| | Example 1 | Example 2 | Example 3 | Example 4 | Example 5 | Comp. Example 1 | Comp. Example 2 | Comp. Example 3 |
|---|---|---|---|---|---|---|---|---|
| Crack | 4 | 4 | 4 | 4 | 4 | 1 | 1 | 2 |
| Surface property | 3 | 3 | 3 | 3 | 2 | 1 | 1 | 1 |
| Ink absorbency | 4 | 4 | 4 | 4 | 4 | 3 | 2 | 3 |
| Image density | 2.01 | 2.05 | 1.9 | 2.07 | 2.05 | 2.05 | 2.11 | 2.01 |

As is evident from the above examples, with respect to crosslinking properties, borax salt is superior to ortho-boric acid, and their contents after drying are also different. In addition, alumina hydrate as a pigment shows drastic variations in viscosity at approximately pH 7. The pigment has characteristic of low viscosity on the acidic side and high viscosity on the alkali side. In addition, an aqueous solution of borax salt shows alkalinity, while the ortho-boric acid aqueous solution shows acidity. In addition, the coating liquid used for the formation of an ink-receiving layer is acidic and dissolves alumina hydrate. The reaction at the liquid-to-liquid interface varies at approximately pH 7. Therefore, the crosslinking reaction of the above PVA surely occurs in addition to generate the thickening and the aggregation of alumina hydrate. Water as a solvent (preferably, pure water for an anti-waste measure to alumina) is separated from PVA provided as a binder and penetrates through the substrate. Furthermore, when the pH measurement is performed on the cross section of the ink-receiving layer formed as described above, the first layer region (e.g., the surface thereof) as defined in the present invention shows pH 6.2 to pH 6.4, while the second layer region shows approximately pH 6.8. As described above, in the examples described above, each aspect of the present invention is implemented to exert its effects.

The present invention achieves more distinct effects when applied to an inkjet recording system, particularly a bubble-jet type recording head, and a recording apparatus. In other words, an image can be formed on the recording medium of the present invention by discharging ink droplets from the recording head to enhance the effects of the present invention. A typical structure and operational principle thereof is disclosed in U.S. Pat. Nos. 4,723,129 and 4,740,796, and it is preferable to use this basic principle to implement such a system. Although this system can be applied to both on-demand type and continuous type ink jet printing systems, it is particularly effective in the on-demand type apparatus. This is because the on-demand type apparatus has electro-thermal transducers, each disposed on a sheet or liquid passage that retains liquid (ink), and operates as follows: first, one or more drive signals which correspond to printing information and induce a sudden temperature rise that exceeds the nucleate boiling are applied to the electrothermal transducers to cause thermal energy; second, the thermal energy causes the film boiling on heating portions of the printing head; and third, bubbles are grown in the liquid (ink) corresponding to the drive signals. By using the growth and collapse of the bubbles, the ink is ejected from at least one of the ink ejection orifices to form one or more ink droplets. The drive signal in the form of a pulse can achieve ink ejection particularly excellent in responsiveness and is more preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that conditions for the invention related to the rate of the temperature rise of the heating portions described in U.S. Pat. No. 4,313,124 be adopted to achieve better printing.

According to the present invention, as described above, there are two findings. The first finding is that it is important to generate a mechanism while retaining the state of mixture in a coating liquid as long as possible in the coating liquid. That is, the mechanism allows a binder in a coating liquid to be located around a pigment to be aggregated and to bind the pigment. The second finding is that it is important to make a uniform distribution of the binder in the recording medium. That is, variations in the existence state of the binder forms a portion where the ink is absorbed excessively and the concentration of the ink is thus decreased. On the other hand, a decrease in the absorbency of ink leads to a decrease in image quality. Based on those findings, therefore, each of new problems described above can be solved by each of the above inventions. Consequently, a recording medium having excellent ink absorbency and coloring property, while retaining the desired characteristics of an ink-receiving layer, and a method of manufacturing such a recording medium with excellent productivity were provided.

What is claimed is:

1. A recording medium comprising on an ink-recording surface side an ink-receiving layer that contains at least a pigment for retaining a coloring material of ink and a binder for the pigment, wherein the ink-receiving layer includes a first layer region where the binder is cross-linked by a first crosslinking agent to become uniform relative to the pigment, and a second layer region where the binder is cross-linked by a second crosslinking agent such that the degree of crosslinking of the second layer region is larger than that of the first layer region, wherein the first layer region is located closer to the ink-recording surface side than the second layer region, and wherein the binder is substantially uniformly distributed in the ink-receiving layer.

2. A recording medium according to claim 1, wherein the first crosslinking agent and the second crosslinking agent contain the same element, and the degree of crosslinking is a relative quantitative difference between the element in the first layer region and the element in the second layer region, which is brought about by the first and second crosslinking agents.

3. A recording medium according to claim 1, wherein the ink-receiving layer is formed by applying a coating liquid on a wet surface, the coating liquid being prepared by dissolving and mixing at least alumina hydrate as the pigment, polyvinyl alcohol as the binder and ortho-boric acid as the first crosslinking agent for the formation of the first layer region, the wet surface containing tetraborate as the second crosslinking agent for the formation of the second layer region.

4. A recording medium according to claim 3, wherein the content of the ortho-boric acid contained in the coating liquid per unit area is less than the content of the sodium tetraborate contained in the wet surface per unit area.

5. A recording medium according to claim 2, wherein the pigment is alumina hydrate, the binder is polyvinyl alcohol, the same element contained in the first and second crosslinking agents is boron "B" and the content of boron "B" in the second layer region is at least twice as high as the content of boron "B" in the first layer region.

6. A recording medium according to any one of claims 1 to 5, wherein the ink-receiving layer has a weight of 30 $g/m^2$ or more.

* * * * *

UNITED STATES PATENT AND TRADEMARK OFFICE

CERTIFICATE OF CORRECTION

PATENT NO. : 7,244,478 B2
APPLICATION NO. : 10/664872
DATED : July 17, 2007
INVENTOR(S) : Yuji Kondo et al.

It is certified that error appears in the above-identified patent and that said Letters Patent is hereby corrected as shown below:

ON THE TITLE PAGE

In Item (56), FOREIGN PATENT DOCUMENTS,

"JP 1 226 959 A2" should read --EP 1 226 959 A2--.

COLUMN 1

Line 42, "recoding" should read --recording--.

COLUMN 2

Line 12, "strengthning" should read --strengthening--.

Line 66, "Further more" should read --Furthermore--.

COLUMN 5

Line 52, "Particular" should read --particular--.

COLUMN 6

Line 14, "cross-lining" should read --cross-linking--.

Line 62, "high" should read --highly--.

COLUMN 9

Line 15, "an" should read --a--.

COLUMN 13

Line 37, "10 $gm^2$" should read --10 $g/m^2$--.

COLUMN 14

Line 22, "$g/M^2$" should read --$g/m^2$--.

UNITED STATES PATENT AND TRADEMARK OFFICE

CERTIFICATE OF CORRECTION

PATENT NO. : 7,244,478 B2
APPLICATION NO. : 10/664872
DATED : July 17, 2007
INVENTOR(S) : Yuji Kondo et al.

It is certified that error appears in the above-identified patent and that said Letters Patent is hereby corrected as shown below:

COLUMN 15

Line 53, “detects” should read --defects--.

Line 65, “had” should read --hand--.

COLUMN 22

Line 33, “an” should read --a--.

Line 35, “an” should read --a--.

COLUMN 24

Line 61, “mol/$m^2$” should read --mol/$m^2$.--.

COLUMN 25

Line 30, “g/$m^2$followed” should read --g/$m^2$, followed--.

Signed and Sealed this

Twentieth Day of May, 2008

JON W. DUDAS
*Director of the United States Patent and Trademark Office*